US008210151B2

(12) United States Patent
Drachko

(10) Patent No.: US 8,210,151 B2
(45) Date of Patent: Jul. 3, 2012

(54) VOLUME EXPANSION ROTARY PISTON MACHINE

(76) Inventor: Yevgeniy Fedorovich Drachko, Kiev (UA)

( * ) Notice: Subject to any disclaimer, the term of this patent is extended or adjusted under 35 U.S.C. 154(b) by 261 days.

(21) Appl. No.: 12/743,582

(22) PCT Filed: Dec. 27, 2007

(86) PCT No.: PCT/UA2007/000080
§ 371 (c)(1),
(2), (4) Date: May 19, 2010

(87) PCT Pub. No.: WO2009/072994
PCT Pub. Date: Jun. 11, 2009

(65) Prior Publication Data

US 2010/0251991 A1 Oct. 7, 2010

(30) Foreign Application Priority Data

Dec. 4, 2007 (UA) ..... 200713546

(51) Int. Cl.
*F02B 53/00* (2006.01)
*F01B 13/04* (2006.01)
*F03C 2/00* (2006.01)

(52) U.S. Cl. ..... 123/245; 123/241; 123/242; 123/243; 123/43 B; 418/34; 418/35; 418/36; 418/37

(58) Field of Classification Search ..... 123/245, 123/241, 242, 243, 43 B; 418/33–38
See application file for complete search history.

(56) References Cited

U.S. PATENT DOCUMENTS

| | | | | |
|---|---|---|---|---|
| 3,592,571 | A * | 7/1971 | Drury | 418/36 |
| 3,829,257 | A * | 8/1974 | Goering | 418/36 |
| 4,311,442 | A | 1/1982 | Simon | |
| 4,419,057 | A | 12/1983 | Menioux | |
| 5,147,191 | A * | 9/1992 | Schadeck | 418/36 |
| 5,304,048 | A * | 4/1994 | Huang | 418/36 |
| 5,501,182 | A * | 3/1996 | Kull et al. | 418/36 |
| 5,527,165 | A * | 6/1996 | Schadeck | 418/36 |
| 6,461,127 | B1 * | 10/2002 | Kim | 418/36 |
| 6,739,307 | B2 | 5/2004 | Morgado | |

FOREIGN PATENT DOCUMENTS

| | | |
|---|---|---|
| FR | 2 694 336 A1 | 2/1994 |
| RU | 2 100 653 C1 | 12/1997 |
| RU | 2 302 539 C2 | 7/2007 |

OTHER PUBLICATIONS

International Search Report, Jul. 15, 2008, from International Phase of the instant application.

* cited by examiner

*Primary Examiner* — Mary A Davis
(74) *Attorney, Agent, or Firm* — Jackson Patent Law Office

(57) ABSTRACT

The inventive volume expansion rotary piston machine includes a body (1) with a circular working cavity which is provided with and intake and exhaust channels (18, 19) and in which bladed pistons (5, 6) are disposed on two coaxial shafts (2, 3). Said shafts have arms (4) which are connected, by means of connecting rods (10), to crankshafts with planet toothed wheels which are fastened to said crankshafts and are engaged with a fixed central toothed wheel (12). The volume expansion rotary piston machine comprises an output shaft (7) with an eccentric (8) on which a planet wheel (11) with a carrier (9) are rigidly connected and mounted, and which planet wheel is kinematically connected to the arms (4) of the two shafts (2, 3) by means of the connecting rods (10).

7 Claims, 14 Drawing Sheets

VOLUME EXPANSION ROTARY PISTON MACHINE

TECHNICAL FIELD

The claimed positive displacement rotary-piston machine can be used as an internal combustion engine and as external combustion engine, as well as a pump or a blower of various gases.

The present invention relates to kinematics and the structure of rotary-piston machines equipped with a planetary train. Such train provides for a reciprocal and relative rotationally oscillatory movement of the positive-displacement members of the rotary-piston machines, such as vanes, plungers, cups that are disposed in one casing (stage).

The rotary-piston machines equipped with such planetary trains, depending on any auxiliary equipment, can operate as rotary internal combustion engines on any liquid and/or gaseous fuel with internal and/or external carburation. Also, rotary internal combustion engines with such kinematic trains can be used as rotary external combustion engines operating on the Stirling principle [1].

Such machines are designed for:

(a) various, preferably small-size vehicles such as motorcars, cabs and light-duty trucks;

small-size water crafts such as motorboats, small ships, and yachts;

ultralight and light aircraft such as paramotors, powered hang gliders, airplanes, and particularly light-weight helicopters;

(b) motor systems for recreational activities and leisure sports, such as motorcycles, four wheeled bikes, scooters, and snowmobiles;

(c) tractors and other farm implements, preferably for farms, and (d) compact and mobile units such as "rotary internal combustion engine-electric generator."

Also, positive displacement rotary-piston machines with such mechanical linkages can operate as compressors, blowers, pumps for air and/or various gases:

(a) to fill various receivers, e.g., tires of motorcars and airplanes;

(b) to supply compressed air for various industrial applications, e.g., various sprayers and air blowers.

As used herein:

the term "rotary internal combustion engine" means an engine having at least four vanes mounted on coaxial shafts disposed in at least one annular casing (stage). There can be several such casings (stages) and they can be arranged adjacent to each other;

the term "face" means a side surface of each piston on one side adjoining on its periphery the inner walls of the annular casing;

the term "working chamber" means space confined between the inner wall of the casing and the piston faces. It has at least four instant subchambers, simultaneously existing and varying in volume. In operation, the chamber of the rotary-piston machines has a constant volume independent of the angular displacement of the pistons in respect of their "zero" position.

The term "instant subchamber" means each variable portion of the chamber, confined between the faces of neighboring pistons and the inner walls of one stage and where the operating cycles take place one after another.

BACKGROUND ART

Known in the art are rotary vane machines with planetary trains, designed for the above-mentioned applications, e.g., by E. Kauertz, U.S. Pat. No. 3,144,007 for Rotary Radial-Piston Machine, issued 1967 (appl. Aug. 11, 1964); U.S. Pat. No. 6,886,527 ICT for Rotary Vane Motor.

Such machines are disclosed in German Patent No. 142119 issued 1903; German Patent No. 271552 issued 1914, cl. 46 a6 5/10; French Patent No. 844 351 issued 1938, cl. 46 a5; U.S. Pat. No. 3,244,156 issued 1966, cl. 12-8.47 and others.

Mechanisms and machines for similar applications are disclosed in Russian Patent No. 2 013 597, Int. cl.$^5$ F02B 53/00; Russian Patent No. 2 003 818, Int. cl.$^5$ F02B 53/00; Russian Patent No. 2 141 043, Int. cl.$^6$ F02B 53/00, F04C 15/04, 29/10, issued 1998; Ukrainian Patent No. 18 546, Int. cl. F02B 53/00, F02G 1/045, issued 1997.

Planetary trains used in the prior-art machines provide for mutual and relative rotationally-oscillatory movement of their compression members such as pistons. However, in case the required operating time is several thousand hours, the prior-art planetary trains are incapable of transmitting to the output shaft significant power from the pistons, e.g., several thousands of kilograms, during the power stroke in the case that the machine is the rotary internal combustion engine.

The prior-art rotary-vane machines with such planetary trains have the following common structural features:

a casing having an annular chamber and an intake port and exhaust port;

at least two pairs of pistons fixed on two drive shafts coaxial with the annular surface defining the chamber, and at least one of the drive shafts having a crank;

an output shaft coaxial with the drive shafts and having a carrier, at least one external planetary gear meshed with a stationary central gear coaxial with the surface defining the chamber and with the drive shafts;

crankshaft(s) coaxial with the planetary gear(s);

connecting rods pivotally linking the arms of the drive shafts and crankshafts of the planetary gears.

The planetary train of such machines has a number of disadvantages. First, the external planetary gears have to be large-sized to make sure they are efficient in transmitting workload. Second, the rate of rotation of planetary gears and the crankshafts coaxial with the planetary gears must be several times that of the output shaft, and thus operating conditions and the service life of the bearings are deteriorated. Third, the crankshafts and planetary gears coaxial with them are disposed on the carrier at a significant radial distance from the axis of the output shaft. For this reason, significant centrifugal forces act on them producing additional loads on the bearings of the planetary gears to also decrease the service life of the rotary-piston machine.

The closest prior art is disclosed in U.S. Pat. No. 6,739,307, US Cl. 123/245, issued May 25, 2004 for Internal Combustion Engine and Method to Ralph Gordon Morgado.

This rotary engine comprises a casing having a working chamber coaxial with an output shaft, pistons disposed within the working chamber and fixed on two concentric drive shafts. The shafts serve as a link between the space-displacing gas-dynamic section of the engine and the planetary train of this engine.

The planetary train of such engine comprises a central gear fixed on the casing and coaxial with the output shaft, and two concentric drive shafts. On the side of the gas-dynamic section, there are the pistons mounted on the shafts, and on the other, i.e., kinematic side, there are arms. There is a carrier affixed to the output shaft, crankshafts and planetary gears coaxial with the crankshafts, all rotatably mounted on the carrier, the planetary gears being meshed with the central gear. The mechanical linkage thus described is closed by a pair of connecting rods pivotally connecting the crankshafts with the arms on both drive shafts.

Such planetary train suffers from many drawbacks.

First, complexity of the planetary train, which is due to a number of parts of the same kind, such as the planetary gears and crankshafts coaxial with them. This increases the cost of production, consumption of materials, and the weight of the engine.

Second, high angular velocities of the planetary gears and the crankshafts affixed to them, which velocities are several times higher than the rate of rotation of the output shaft. Under this condition, excessively large velocity load on the bearings occurs to thus decrease reliability and service life of the planetary train.

Third, limitations on work loads by the tooth engagement of the planetary gears externally meshing with the central gear and having a tooth overlapping of a relatively small amount, so that such gear pair offers small load-carrying capability.

Fourth, the crankshafts and planetary gears, being disposed on the carrier at an amply-dimensional radial distance from the axis of the output shaft, cause the development of great centrifugal forces and loads acting on the bearings and accordingly tend to decrease the service life of the planetary train.

From the aforesaid it will be obvious that the drawbacks of the prior-art engine and particularly its planetary train stem from design features and operation conditions of such structural members as crankshafts and associated planetary gears, notably the gear ratio, the type of meshing—external, the crankshafts and planetary gears disposed on the carrier at an amply-dimensional radial distance from the axis of the output shaft.

DISCLOSURE OF THE INVENTION

This invention has for its object simplification of the planetary train in a positive displacement rotary-piston machine and the provision of such train structure that would be more reliable in operation and would have increased expectation of life.

This objective is accomplished by providing a positive displacement rotary-piston machine comprising:

(a) a casing having an annular working chamber and an intake port and exhaust port, (b) at least two drive shafts coaxial with the annular surface defining the working chamber and provided with pistons on one end thereof and with arms on the other end thereof, (c) at least one stationary central gear coaxial with the surface defining the working chamber and with the drive shafts, (d) an output shaft concentric with the drive shafts and having a carrier, (e) crankshafts connected to the arms of the carrier of the output shaft and carrying planetary gears meshed with the stationary central gear, (f) connecting rods linking the arms of the drive shafts and crankshafts, and characterized in that the output shaft has an offset portion carrying the carrier and a planetary gear, the planetary gear being in mesh with the stationary central gear on the internal teeth thereof with a gear ratio $i=n/(n+1)$, where $n=1, 2, 3 \ldots$, i.e. a series of integers), the carrier is pivotally connected to the arms of both drive shafts through the connecting rods, and the number of vanes mounted on each drive shaft is $n+1$.

In contrast to the closest prior art, the invention is directed toward decreasing absolute angular velocities of the crankshafts and the planetary gears fixed on them. This is accomplished by decreasing the gear ratio and by changing rotation of the drive shafts to the opposite direction compared to that of the output shaft (is not obvious for those skilled in the art). Also, the internal toothing provides for higher load-carrying capability.

In the planetary train of the invention, several planetary gears and associated crankshafts have been replaced by a single planetary gear and a carrier affixed to the gear, both being connected to the offset portion of the output shaft. This arrangement provides for:

(a) a design simplification due to decreasing the number of planetary gears and to the exclusion of associated crankshafts. Also, an additional simplification in the output shaft is achieved by substituting the offset portion for the cumbersome carrier having arms of a significant radial extension;

(b) use of the internal toothing in the planetary gear pair having a great face contact ratio to enable large torques to be transmitted at low speeds of relative displacement of the teeth in mesh with minimal frictional losses and wear;

(c) a decrease in angular velocity of the planetary gear and extension of the service life of its bearings;

(d) the substitution of oscillation with a low angular velocity and transmission of large loads with extended expectancy of operation for rotation in the pivot-type couplings of the connecting rods;

(e) a decrease in the radial distance of the placement of the planetary gear and a corresponding decrease in effect of the centrifugal force on its bearings, which as a whole provide a solution of the aforestated problem.

The first additional difference consists in that the annular working chamber of the casing is toroidal.

This makes it possible to do away with angular joints between sealing components of the pistons and to use compression rings to thereby minimize leaks of compressed gases and simplify the sealing system as a whole.

Another additional difference consists in that the casing has at least one precombustion chamber communicating with the annular working chamber through a transfer passage.

In the positive displacement machine of the invention, which is generally used as a rotary internal combustion engine, the precombustion chamber, being external of the annular working chamber, is used as an external combustion chamber thereby reducing a thermal load on the walls of the working chamber and rotary pistons. This contributes to enlargement of the service life span and to an increase in reliability of rotary internal combustion engines.

An additional difference consists in that the transfer passage is tangential with respect to the axis of symmetry of the precombustion chamber.

In the rotary-vane machine of the invention, which is generally used as a rotary internal combustion engine, the tangential transfer passage is used as a source of a turbulent or vortex flow of gas in the precombustion chamber in order to improve fuel-air mixture formation and combustion. This contributes to a smooth and "soft" running of the engine to improve reliability and extend its life time.

An additional difference also consists in that the rotary-vane machine comprises a common output shaft with at least two offset portions and a casing consisting of at least two coaxial annular working stages. The working stages and the offset portions can be mutually set at an angle of 0° through 180°, and the setting will be determined in accordance with conditions and requirements for the operation of the rotary-vane machine.

The rotary-vane machine according to this embodiment of the invention, which is generally used as a rotary internal combustion engine, has a torque without a negative component and without considerable variations of its magnitude. It operates with a decreased level of vibrations in conjugation with the load to result in higher reliability and an extended life time.

Yet another additional difference consists in that the working chamber has an intake port and exhaust port respectively connected in pairs to: a heater, regenerator, and cooler of exhaust gases as well as an additional cooler.

This enables the rotary-vane engine to operate on the Stirling principle with an external heat input thus providing for use of any heat source (combustible) to produce mechanical power.

Also, another additional difference consists in that the exhaust ports are provided with straightway valves.

As a rule, such positive displacement machine is used as an air- or a gas blower (compressor).

Simplification of the planetary train is achieved by substituting a single planetary gear with a carrier affixed to the offset portion of the output shaft for several planetary gears and associated crankshafts. Also, the output shaft's design is made simpler by substituting the offset portion for the cumbersome carrier.

A decrease in the angular velocity of the planetary gears and an increase in the magnitude of transmitted workloads due to the gearing is achieved by minimizing the gear ratio in the planetary pair: $i=n/(n+1)$ (where $n=1, 2, 3 \ldots$, i.e. a series of integers), i.e., $i<1$ for an internally toothed gear pair. This provides for a relatively large overlapping of the teeth to enable bearing of greater workloads. Also, as compared with the external toothing, the internal one is characterized by lower frictional losses due to lower relative speeds of the teeth. Again, due to compound motion, the rate of rotation of the planetary gear and the carrier becomes lower while the connecting rods produce only reciprocating oscillatory motion. The velocity load on the bearings is respectively lower, so their load-carrying capability increases to thereby provide for operational reliability and longer service life of the rotary-piston machine as a whole.

Weaker centrifugal forces acting on the planetary gears are the result of a relatively small amount of eccentricity of the offset portion on the output shaft bearing the planetary gear and the carrier. This design substantially decreases centrifugal forces acting on the members of the planetary train to enhance reliability and the service life of the rotary-piston machine as a whole.

BRIEF DESCRIPTION OF THE DRAWINGS

The above as well as other advantages and features of the present invention will be described in greater detail according to the preferred embodiments of the present invention in which:

In the drawings, diagrams illustrate:

in FIG. 1, a longitudinal sectional view of the rotary-piston machine with a planetary train, used as a rotary internal combustion engine;

in FIGS. 2-6, the planetary train with the gear ratio $i=½$ at various angular positions of the pistons and the links of the kinematic chain in dependence of the actual position of the offset portion on the output shaft, namely:

Figure 2:
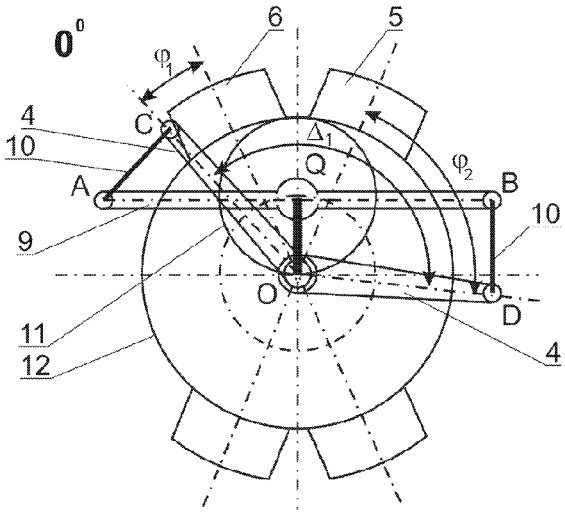
Figure 4:
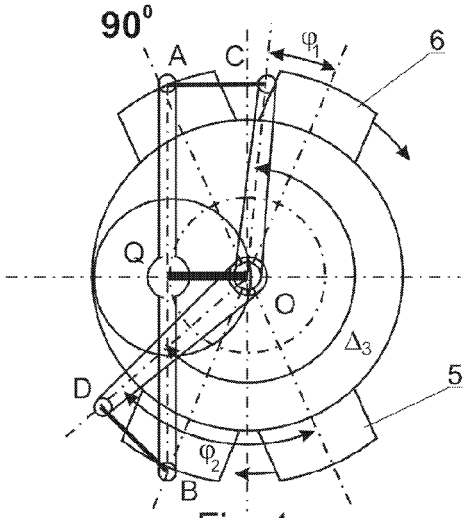
Figure 3:
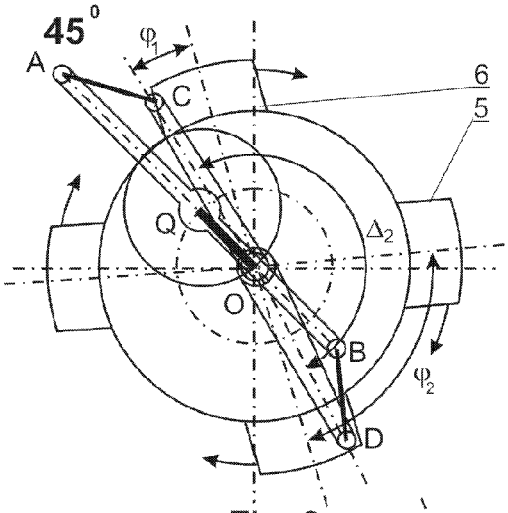
Figure 5:
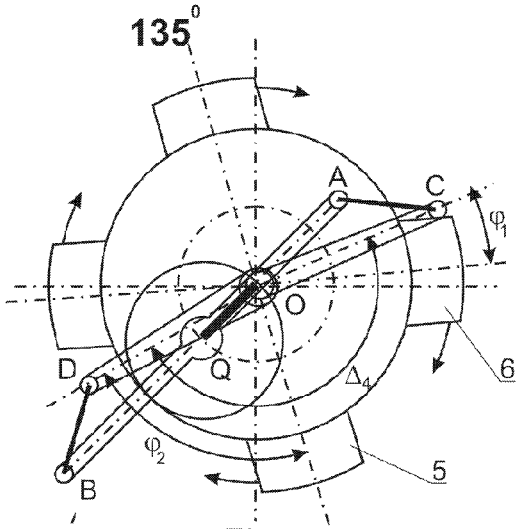
Figure 6:
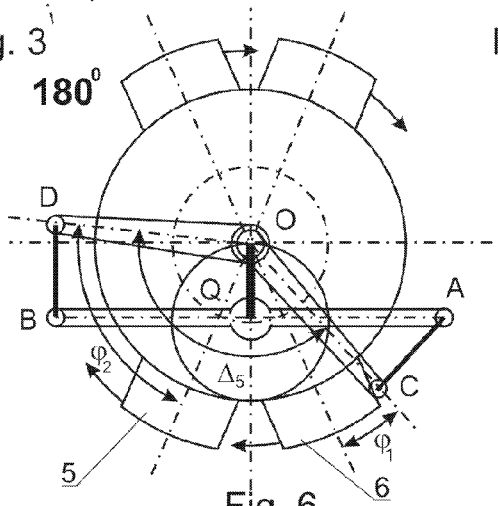
Figure 7:
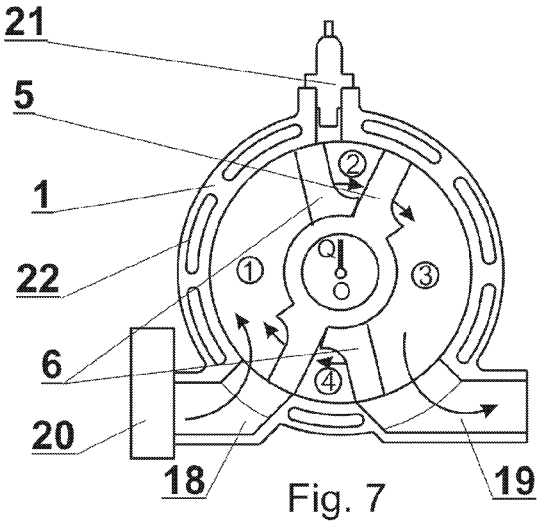
FIGS. 7-11, 15-16, 30-34, 42-43 illustrate various the rotary-piston machines and their operation with characteristics.
Figure 9:
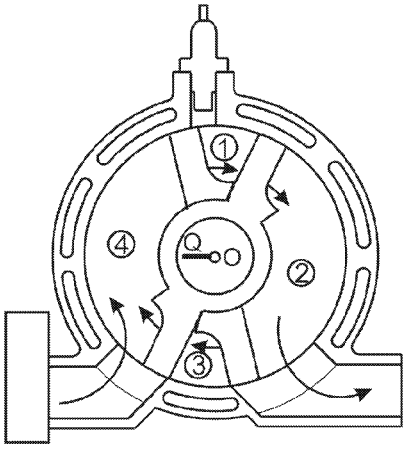
Figure 8:
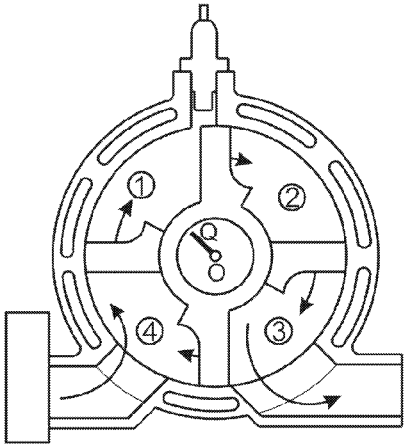
Figure 10:
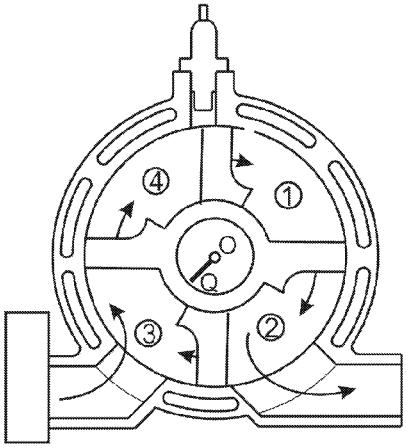
Figure 11:
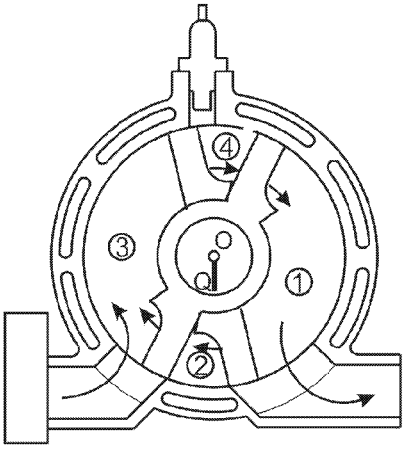
Figure 12:
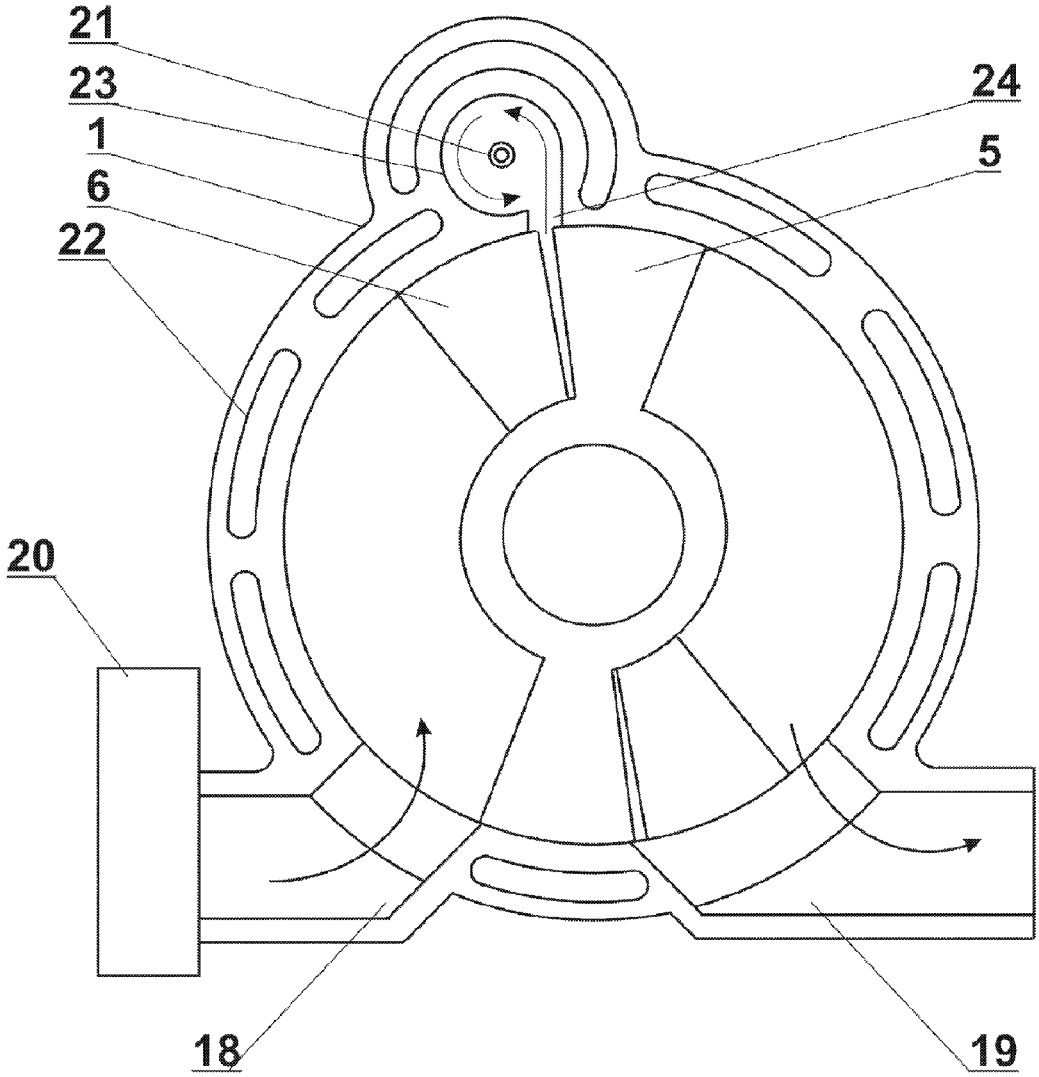
Figure 13:
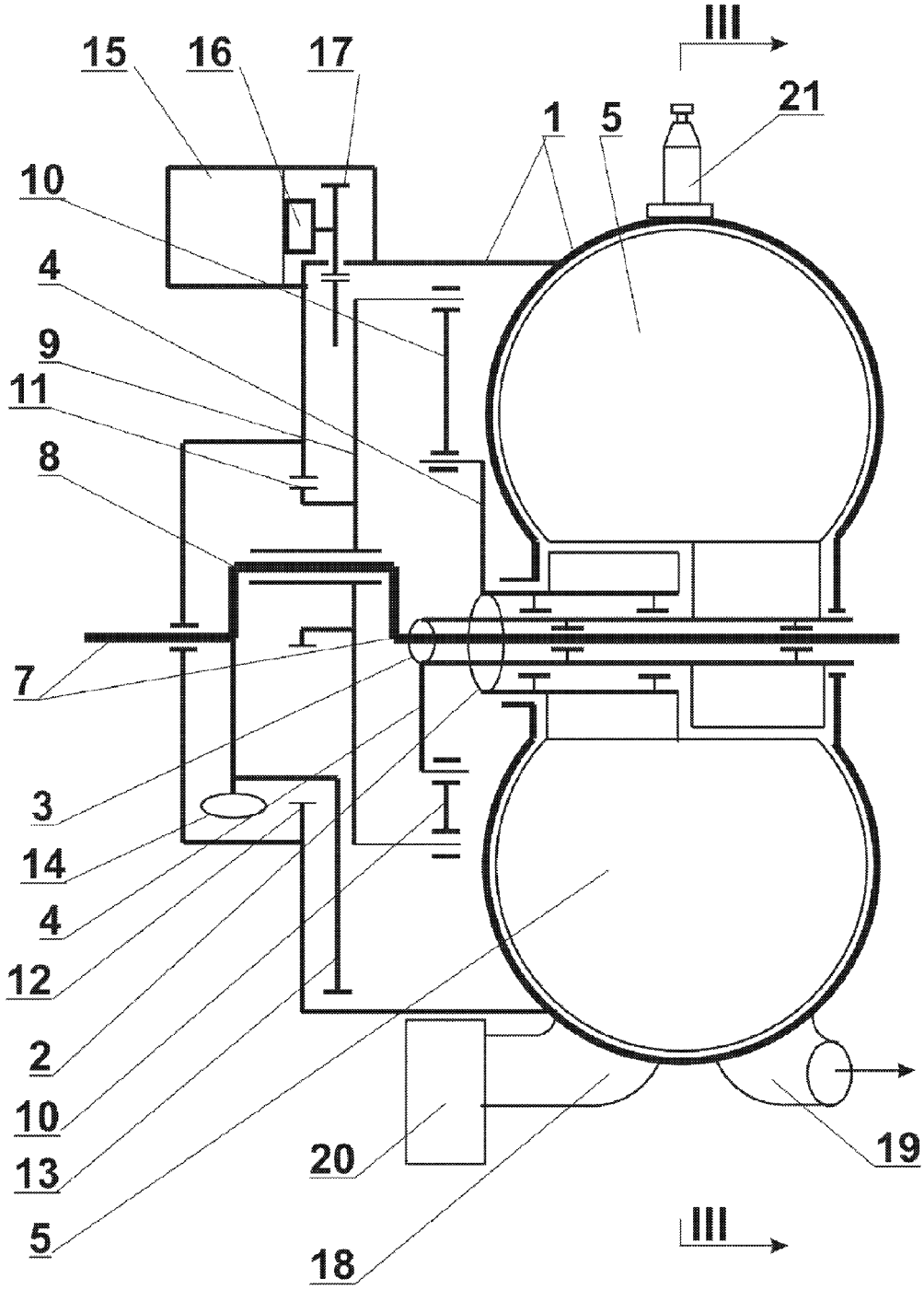
Figure 14:
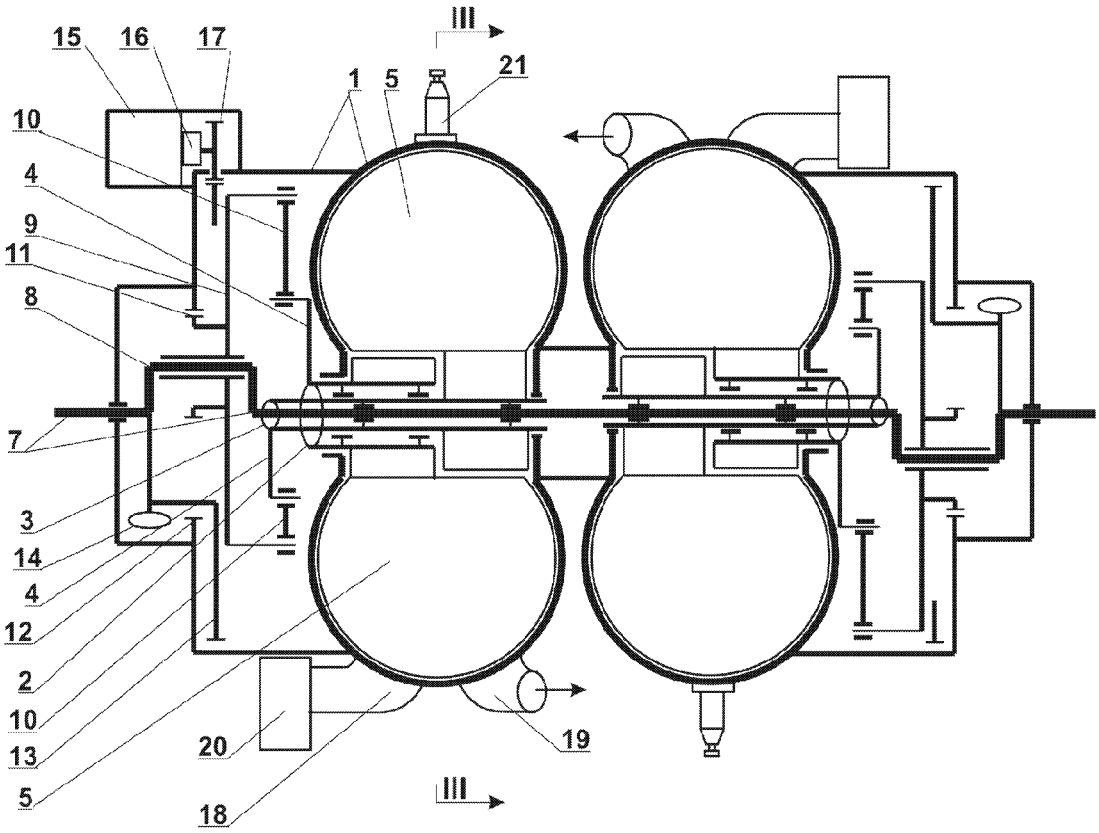
Figure 15:
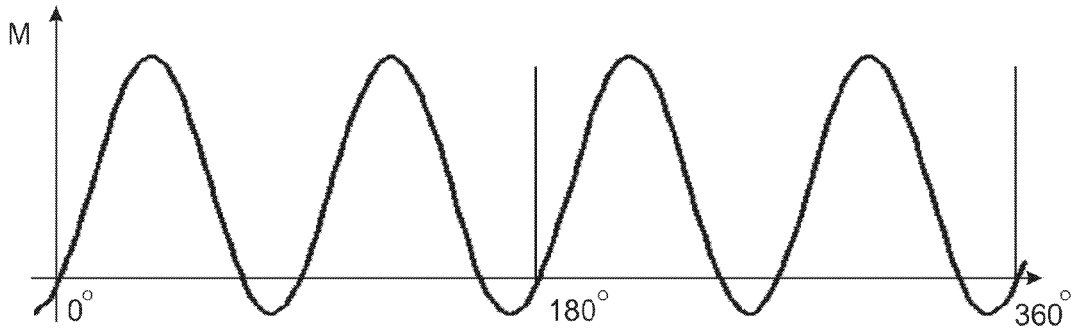
Figure 16:
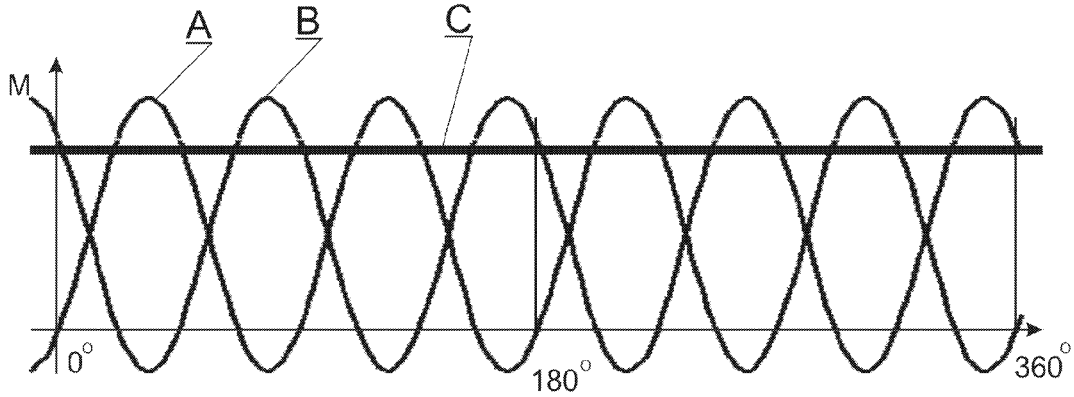
Figure 17:
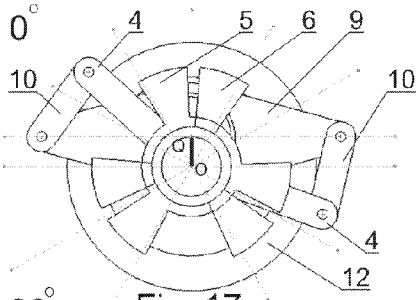
Figure 18:
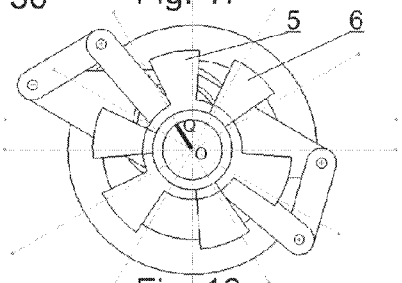
Figure 19:
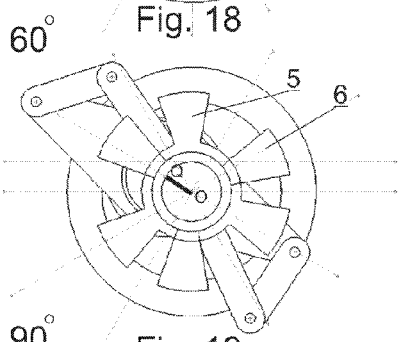
Figure 20:
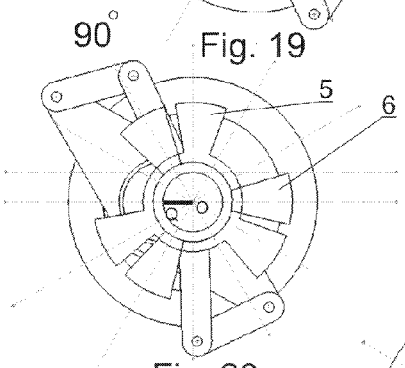
Figure 21:
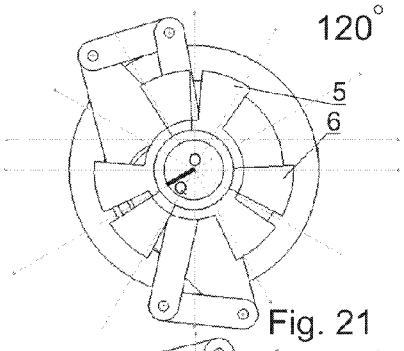
Figure 22:
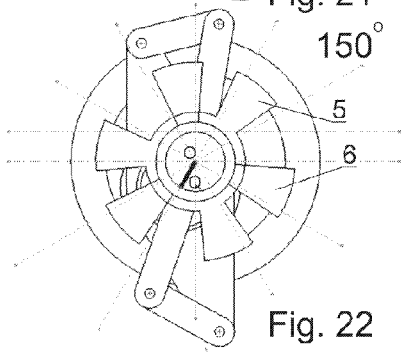
Figure 23:
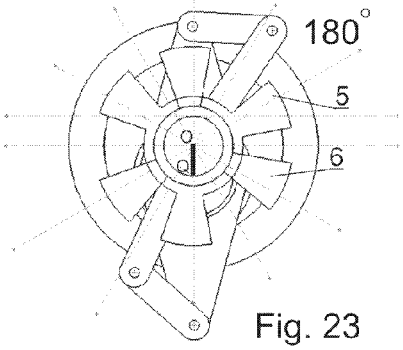
Figure 24:
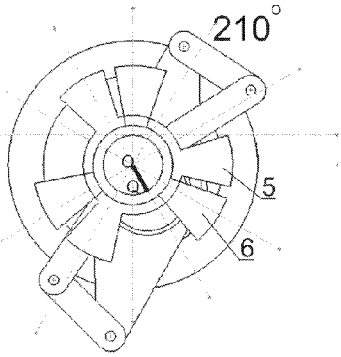
Figure 25:
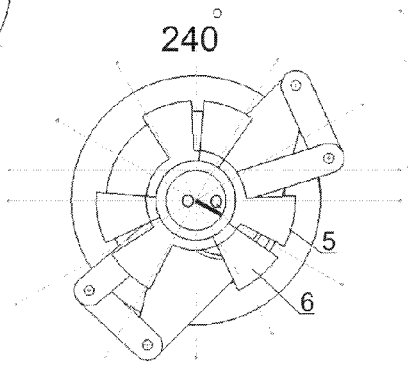
Figure 26:
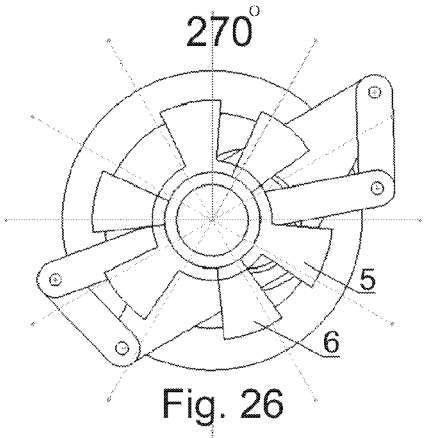
Figure 27:
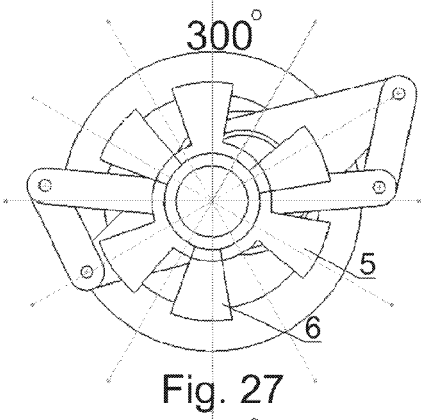
Figure 28:
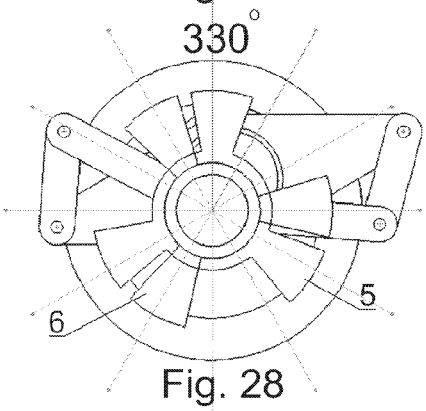
Figure 29:
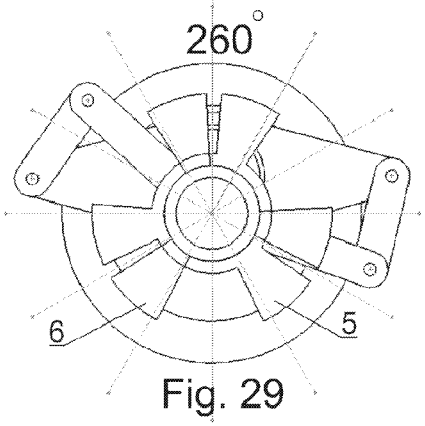
Figure 30:
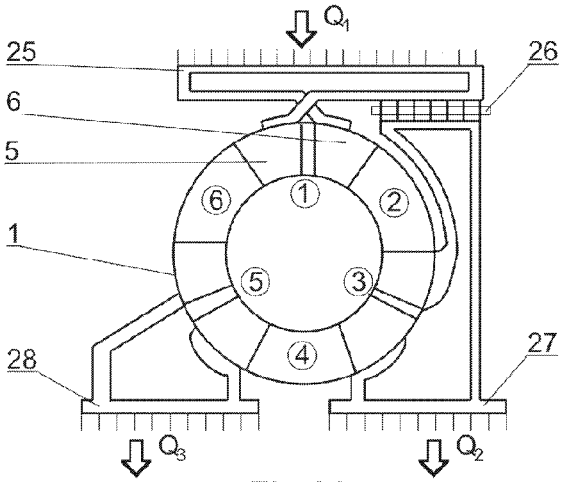
Figure 32:
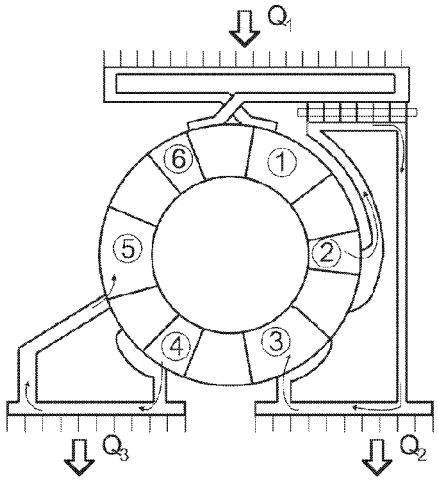
Figure 31:
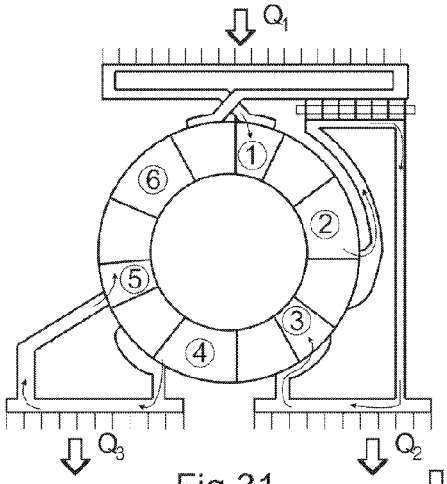
Figure 33:
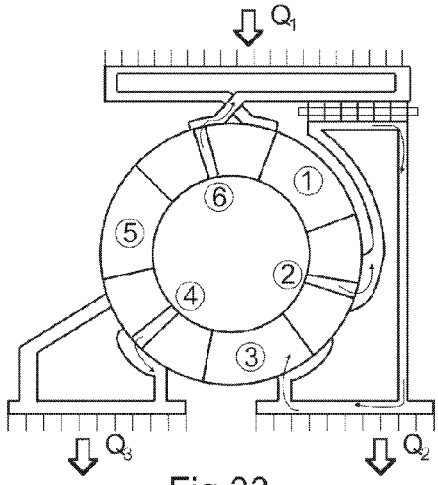
Figure 34:
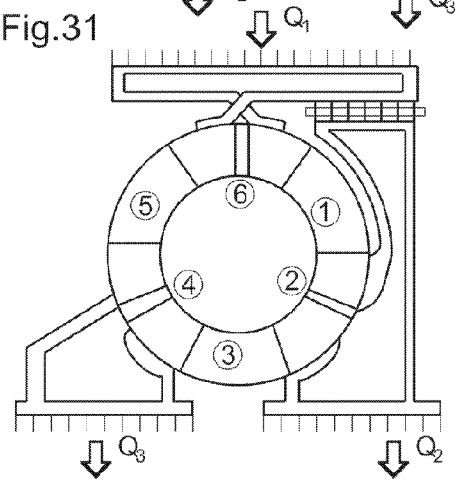
Figure 35:
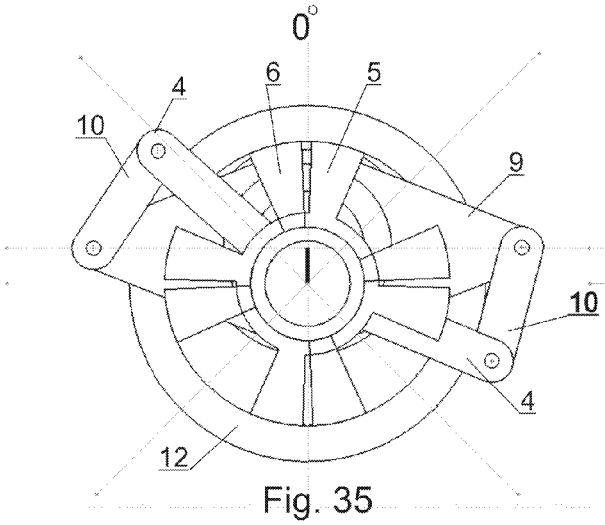
Figure 37:
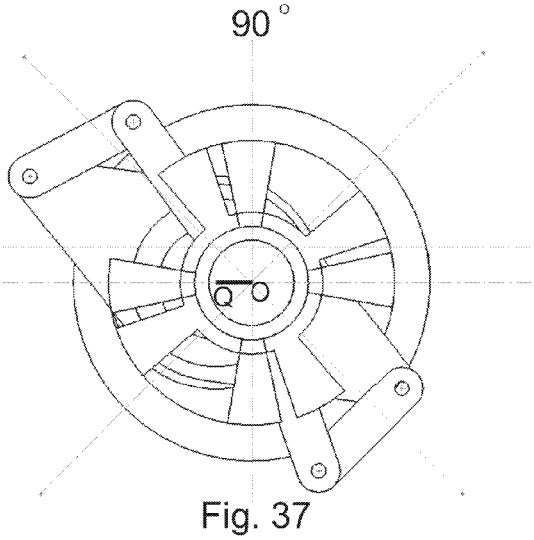
Figure 36:
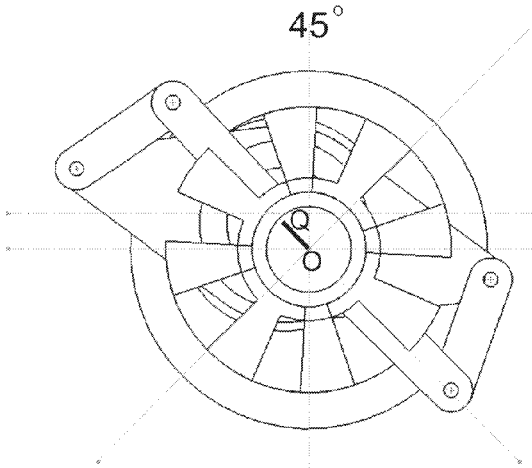
Figure 38:
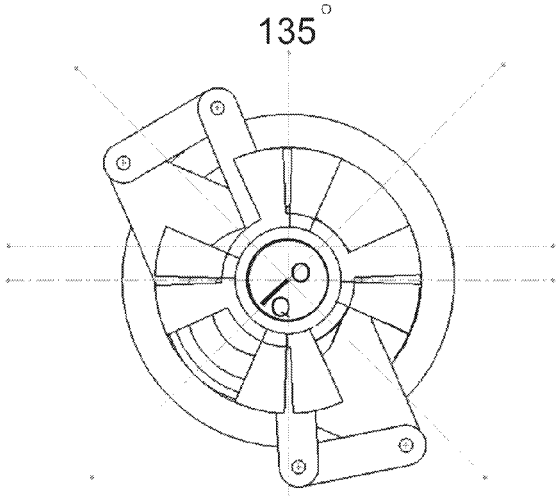
Figure 39:
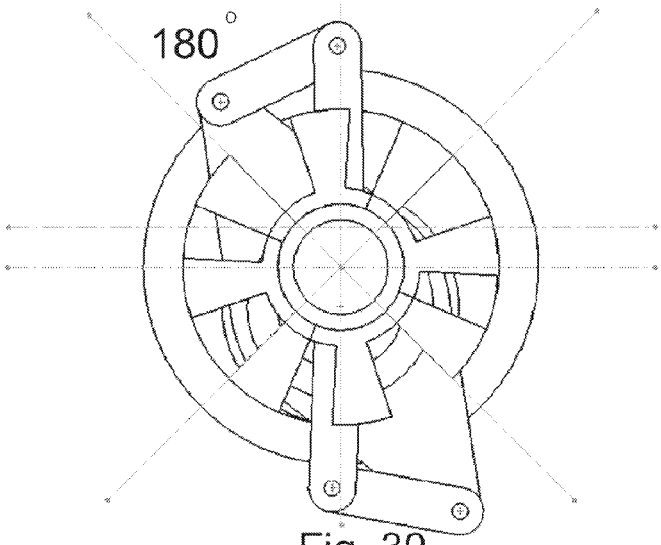
Figure 40:
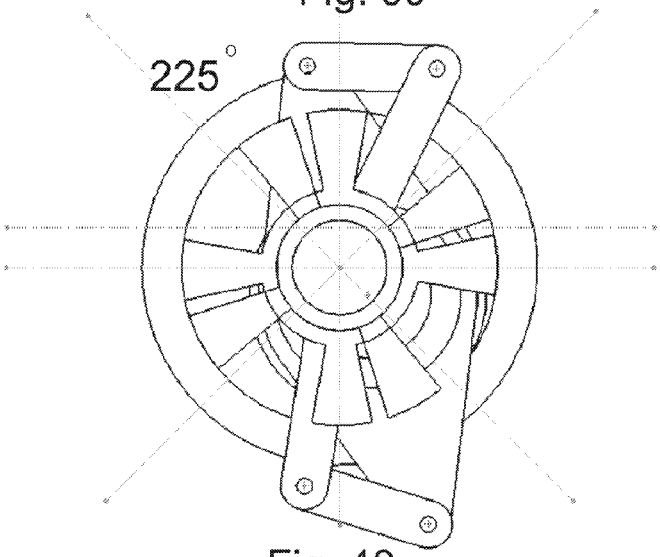
Figure 41:
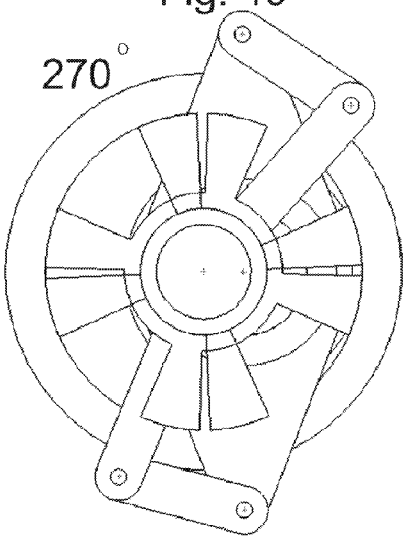
Figure 42:
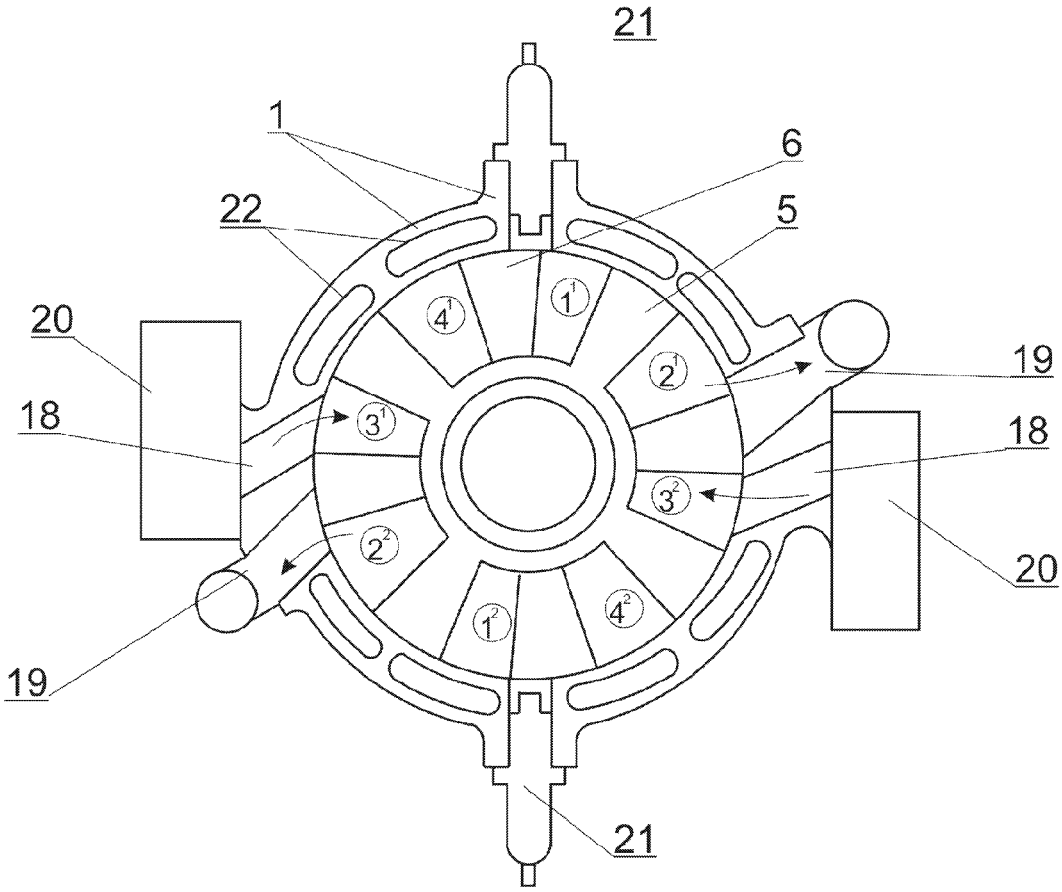

where the carrier with the planetary gear are arranged on the offset portion of the output shaft and the eccentricity of the offset portion designated by the heavy line OQ, the center of the planetary gear designated Q, while the carrier arm designated A and B;

where a pair of arms of the coaxial drive shafts are designated CO and DO;

a pair of connecting rods designated AC and BD connect the carrier AB with the arms CO and DO of the coaxial drive shafts;

in FIG. 2, an initial angular position of the pistons and of their drive mechanism where the initial (upper) angular position of the offset portion for convenience is 0° (360°, 720° etc.);

in FIG. 3, a view similar to FIG. 2 where the output shaft has been turned through 45° counterclockwise (405°, 765°, etc.);

in FIG. 4, a view similar to FIG. 2 where the output shaft has been turned through 90° counterclockwise (450°, 810°, etc.);

in FIG. 5, a view similar to FIG. 2 where the output shaft has been turned through 135° counterclockwise (495°, 855°, etc.);

in FIG. 6, a view similar to FIG. 2 where the output shaft has been turned through 180° counterclockwise (540°, 900°, etc.);

FIGS. 7-11 illustrate a cross-sectional view through the annular working chamber of the casing of the rotary internal combustion engine at various actual positions of the pistons after the output shaft has turned one-half revolution counterclockwise from the initial 0° (upper) angular position of the offset portion OQ, where FIG. 7 is the initial angular position of the pistons in the annular working chamber at the initial (upper) angular position of the offset portion OQ (0°, 360°, 720°, etc.);

FIG. 8 is a view similar to FIG. 7 where the offset portion OQ has been turned through 45° counterclockwise (405°, 765°, etc.);

FIG. 9 is a view similar to FIG. 7 where the offset portion OQ has been turned through 90° counterclockwise (450°, 810°, etc.);

FIG. 10 is a view similar to FIG. 7 where the offset portion OQ has been turned through 135° counterclockwise (495°, 855°, etc.);

FIG. 11 is a view similar to FIG. 7 where the offset portion OQ has been turned through 180° counterclockwise (540°, 900°, etc.);

FIG. 12 illustrates a cross-sectional view through the annular working chamber and the precombustion chamber of the rotary internal combustion engine at the initial position of the pistons in the simplest rotary internal combustion engine (the pistons being shown as sectors unrestricted as to any chamber);

FIG. 13 illustrates a longitudinal section through the planetary train of a rotary internal combustion engine operating as a positive displacement machine having a toroidal working chamber;

FIG. 14 illustrates a gear train diagram (the second embodiment) of a rotary internal combustion engine having a common output shaft with two offset portions for two planetary trains and comprising a casing arranged between the trains and consisting of two similar stages coaxial with one the other. The stages and the offset portions are designed to be settable at an angle in the range of 0° through 180° for each specific application;

FIG. 15 is a graph approximated with a sinusoid showing variations in torque M of a single-stage rotary internal combustion engine as a function of the actual angle ϕ of rotation of the output shaft;

FIG. 16 are graphs approximated with sinusoids showing variations in torque M (as a function of the actual angle ϕ of rotation of the output shaft) of each of two engine stages (curves A and B) as well as the resultant accumulation curve C of a two-stage rotary internal combustion engine;

FIGS. 17-29 illustrate the planetary train with the gear ratio i=⅔ at various angular positions of the pistons and the links of the kinematic chain in dependence of the actual position of the offset portion on the output shaft, namely:

in FIG. 17, an initial angular position of the pistons and of their drive mechanism where the initial (upper) angular position of the offset portion for convenience is 0° (360°, 720° etc.);

in FIG. 18, a view similar to FIG. 17 where the offset portion has been turned through 30° counterclockwise (390°, 750°, etc.);

in FIG. 19, a view similar to FIG. 17 where the offset portion has been turned through 60°;

in FIG. 20, a view similar to FIG. 17 where the offset portion has been turned through 90°;

in FIG. 21, a view similar to FIG. 17 where the offset portion has been turned through 120°;

in FIG. 22, a view similar to FIG. 17 where the offset portion has been turned through 150°;

in FIG. 23, a view similar to FIG. 17 where the offset portion has been turned through 180°;

in FIG. 24, a view similar to FIG. 17 where the offset portion has been turned through 210°;

in FIG. 25, a view similar to FIG. 17 where the offset portion has been turned through 240°;

in FIG. 26, a view similar to FIG. 17 where the offset portion has been turned through 270°;

in FIG. 27, a view similar to FIG. 17 where the offset portion has been turned through 300°;

in FIG. 28, a view similar to FIG. 17 where the offset portion has been turned through 330°;

in FIG. 29, a view similar to FIG. 17 where the offset portion has been turned through 360°;

FIGS. 30-34 illustrate a cross-sectional view through the annular working chamber of the casing of the rotary internal combustion engine operating on the Stirling principle at various actual positions of the pistons after the offset portion has turned one third revolution (compare FIGS. 17-21) counterclockwise from the initial 0° (upper) angular position of the offset portion OQ, where FIG. 30 is the initial angular position of the pistons with respect of the intake and exhaust ports at the initial (upper) angular position of the offset portion OQ at 0° (360°, 720°, etc.);

FIG. 31 is a view similar to FIG. 30 where the offset portion OQ has been turned through 30° (390°, 750°, etc.);

FIG. 32 is a view similar to FIG. 30 where the offset portion OQ has been turned through 60°;

FIG. 33 is a view similar to FIG. 30 where the offset portion OQ has been turned through 90°;

FIG. 34 is a view similar to FIG. 30 where the offset portion OQ has been turned through 120°;

FIGS. 35-41 illustrate the planetary train with the gear ratio i=¾ at various angular positions of the pistons and the links of the kinematic chain in dependence of the actual position of the offset portion on the output shaft, namely:

in FIG. 35, an initial angular position of the pistons and of their drive mechanism where the initial (upper) angular position of the offset portion for convenience is 0° (360°, 720° etc.);

in FIG. 36, a view similar to FIG. 35 where the offset portion has been turned through 45° counterclockwise (405°, etc.);

in FIG. 37, a view similar to FIG. 35 where the offset portion has been turned through 90°;

in FIG. 38, a view similar to FIG. 35 where the offset portion has been turned through 135°;

in FIG. 39, a view similar to FIG. 35 where the offset portion has been turned through 180°;

in FIG. 40, a view similar to FIG. 35 where the offset portion has been turned through 225°;

in FIG. 41, a view similar to FIG. 35 where the offset portion has been turned through 270°;

FIG. 42 illustrates a cross-sectional view through the annular working chamber of the casing of rotary internal combustion engine operating with a planetary train having the gear ratio i=¾ (compare FIGS. 35-41).

Figure 43:
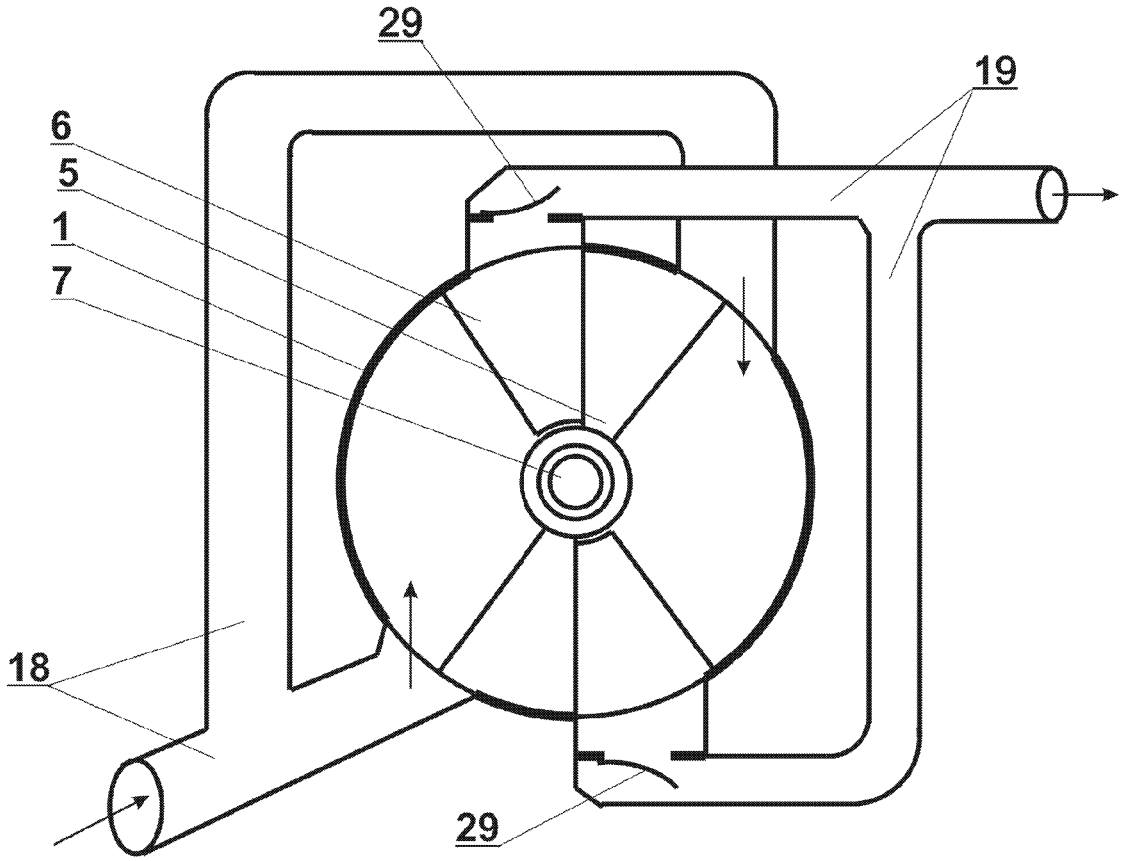

FIG. 43 illustrates the way how the intake and exhaust ports communicate with the annular working chamber of the rotary-piston machine when used as a blower (compressor), for example, of air. In this application, the planetary train has the gear ratio i=½ (compare FIGS. 2-6).

The arrows in FIGS. 1-14, 16, 31-33, 42-43 indicate the flow of working fluids, e.g., a gas, as well as the direction of motion of the pistons.

BEST MODE FOR CARRYING OUT THE INVENTION

The following is a description of some embodiments of the invention, beginning with the description of the positive displacement rotary-piston machine for use as the simplest rotary internal combustion engine, where the structural parts are diagrammatically shown as follows:

a casing 1 having an annular working chamber, an outer drive shaft 2, an inner drive shaft 3, arms 4 of the outer 2 and inner 3 drive shafts, axially symmetrical pistons 5 and 6 fixed on coaxial drive shafts 2 and 3 respectively. The pistons 5 and 6 have radial seals and end-face seals (not shown). They also can have axially symmetrical spaces on their side faces, for example, such that may function as combustion chambers in rotary internal combustion engines, an output shaft 7 shown in FIG. 1 by a heavy line, an offset portion 8 on the output shaft 7, shown as a U-bend in FIG. 1, a carrier 9 journalled on the offset portion 8 of the output shaft 7, connecting rods 10 linking the carrier 9 to the arms 4, a planetary gear 11 fixed on the carrier 9, a stationary central gear 12 meshing with the planetary gear 11 and being coaxial with the drive shafts 2 and 3, the output shaft 7, and the annular working chamber of the casing (stage) 1, a gear rim 13 fixed on the offset portion 8 of the output shaft 7, a counterbalance 14 for balancing the masses of the offset portion 8, the carrier 9, the planetary gear 11, and the connecting rods 10, a starter 15 mounted on the casing 1, an overrunning clutch 16, a gear 17 meshing the gear rim 13, an intake port 18 communicating with the working chamber of the casing (stage) 1, an exhaust port 19 also communicating with the working chamber of the casing (stage) 1, a carburetor 20 (for use in an external carburetion only), a spark plug/fuel injector 21 (the spark plug for use in an external carburetion and/or the fuel injector for use in an internal carburetion), walls 22 defining spaces for cooling the casing (stage) 1.

The simplest rotary internal combustion engine can include a precombustion chamber 23 communicating with the working chamber of the casing (stage) via a transfer passage 24 (FIG. 12).

The positive displacement rotary-piston machine operating on the Stirling principle has a heater 25, regenerator 26, exhaust gas cooler 27, and additional cooler 28 (FIG. 30).

Figure 1:
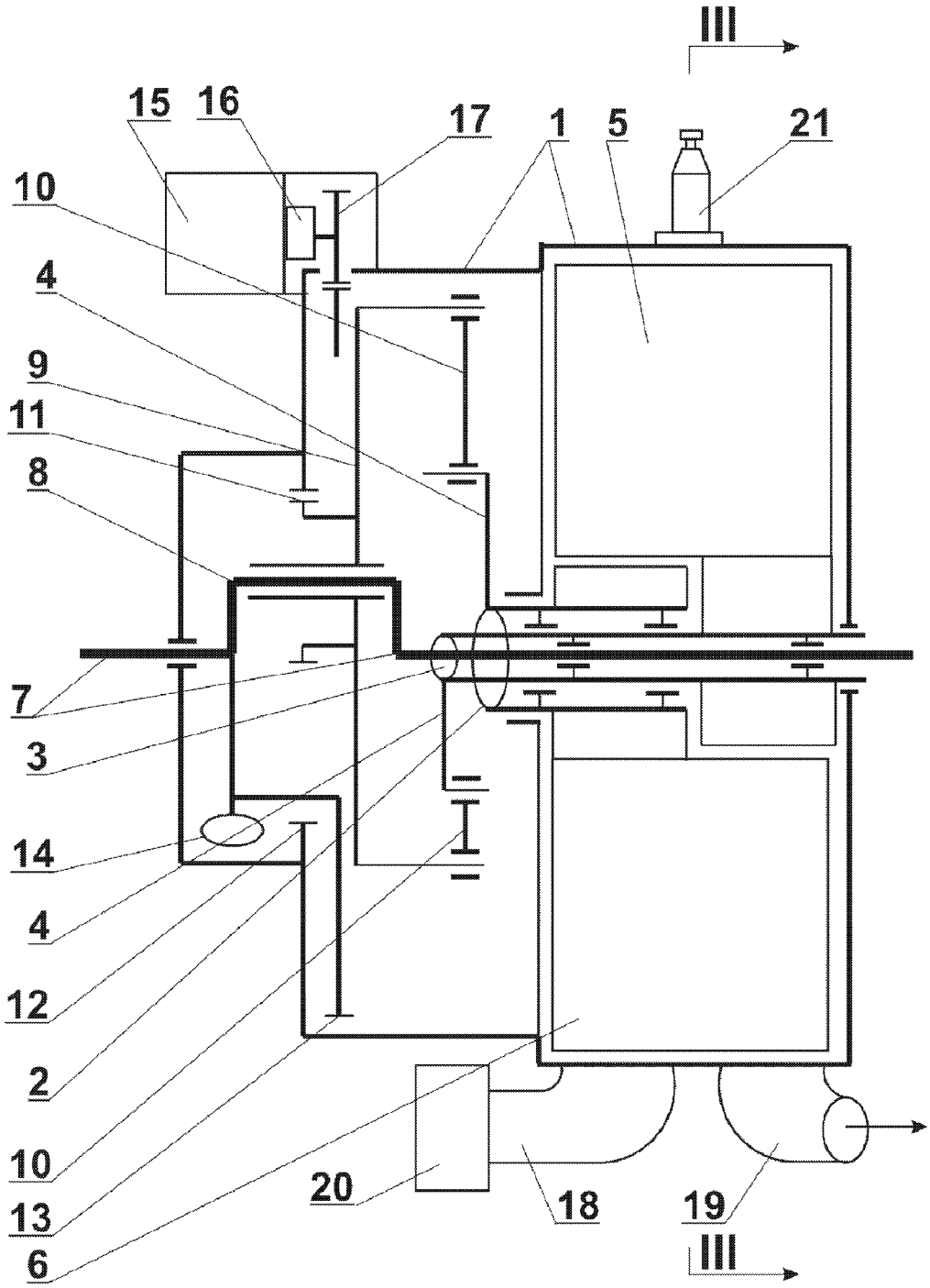
FIGS. 1-6, 13, 14, 17-29, 35-41 illustrate the rotary-piston machine with a planetary train providing various gear ratios $i=n/(n+1)$ (where $n=1, 2, 3, 4$, etc.) as the basis of the positive displacement rotary-piston machine intended for various applications (e.g., engines and compressors)

The positive displacement rotary-piston machine operating as a blower (a compressor as in FIG. 43) is structurally similar to the simplest rotary internal combustion engine (FIG. 1). The only difference is that there are straightway valves 29, such leaf shutters, disposed between the exhaust port 19 and the working chamber. The intake ports 18 may be combined with the exhaust ports 19.

The operation of the positive displacement rotary-piston machine will now be described by the operation of the simplest rotary internal combustion engine having a planetary pair with the gear ratio i=½ (FIG. 1). When the engine is being put in operation, the starter is energized and, by way of the overruning clutch 16 and the gear 17, causes the heavy gear rim 13 to rotate together with the output shaft 7 rigidly connected to the rim and having the offset portion 8 as an integral part thereof. The planetary gear 11 and the carrier 9 both arranged on the offset portion 8 began motion as their axis moves and the planetary gear 11 meshes with the central gear 12. The motion is further transmitted from the carrier 9 via the connecting rods 10 to the arms of the drive shafts 2 and 3 carrying the pistons 5 and 6, which began rotationally oscillate in the working chamber of the casing 1.

This motion is the result of continuous variations in the angular position and an instantaneous distance to the arms of the carrier 9 (linking the connecting rods to the arms 4 of the coaxial drive shafts 2 and 3) with respect to the "zero" point of instantaneous velocities, the point being the pitch point of the gears (the stationary central gear 12 and the planetary gear 11). This provides for continuous variations of linear and angular velocities of the arms 4 and corresponding rotational oscillations of the coaxial drive shafts 2 and 3 together with the pistons 5 and 6 in the working chamber of the casing (stage) 1. At the same time, the output shaft 7 together with the offset portion 8 and the drive shafts 2 and 3 together with the pistons 5 and 6 are in the reverse motion. The counterweight 14 balances the masses of the offset portion 8, planetary gear 11, carrier 9 and heavy gear rim 13 serving as a balance wheel. The gear rim 13 and the counterweight 14 can be combined.

Referring to FIG. 2, there is shown an arbitrarily chosen initial 0° position of the output shaft 7 with the offset portion 8 and the corresponding position of the planetary gear 11 with the carrier 9, of the connecting rods 10 and the arms 4 of the rotary pistons 5 and 6 relative to the stationary central gear 12 and the casing (stage) 1. The eccentricity of the offset portion 8 of the output shaft 7 is designated by heavy line OQ extending vertically, while the carrier 9 designated AB is positioned horizontally above the output shaft 7. The carrier 9 is linked with the drive shafts 2 and 3 by means of the connecting rods 10 shown as straight lines designated AC and BD. At the initial position, the axes, shown by dash-and-dot lines, of the pistons 5 and 6 are symmetrical with respect to the vertical axis at an acute angle thereto. The angle between the axis OC of the arm 4 of the inner drive shaft 3 and the axis of the piston 6 is designated as $\phi_1$=const, while the angle between the axis OD of the arm 4 of the outer drive shaft 2 and the axis of the piston 5 is designated as $\phi_2$=const. In FIG. 2, the angle between the axes of the arms 4 of both drive shafts 2 and 3 is minimal and designated $\Delta_1$.

Next, the output shaft 7 together with the offset portion 8 rotates anticlockwise. At the same time, by virtue of mechanical linkages, the planetary gear 11 rolls over the stationary central gear 12. The planetary gear 11 imparts motion to the carrier 9, which is rigidly connected to the planetary gear 11. This causes continuous variations in the movement of the arms QA and QB of the carrier 9 (both the direction and velocity) with respect to the "zero" point of instantaneous velocities where the point is the pitch point of the gears 11 and 12. These variations in velocities is transmitted via the connecting rods 10 from the axes of arms A and B of the carrier 9 to the axes C and D of the arms 4 of the coaxial drive shafts 2 and 3, and further to the pistons 5 and 6. In this manner the pistons are caused to rotationally oscillate in the working chamber of the casing 1.

Referring to FIG. 3, the output shaft 7 and the offset portion 8 (with the eccentricity OQ) are shown as turned through 45° counterclockwise. The planetary gear 11 with the carrier 9 are also shown as turned through 45°, but clockwise. Because the angles $\phi_1$ and $\phi_2$ are constant, the connecting rods 10 designated AC and BD are moved apart by the arms 4 designated OC and OD to form an angle $\Delta_2>\Delta_1$. The pistons 5 and 6 are also moved apart by a corresponding amount.

When the output shaft has further rotated through an angle of 90° (FIG. 4) the carrier 9 takes the vertical position, while the connecting rods 10 designated AC and BD keep on moving the arms 4 designated OC and OD apart to form an angle $\Delta_3>\Delta_2>\Delta_1$. As this takes place, the pistons 5 and 6 are found to be brought to the vertical axis again just as in FIG. 2.

When the output shaft has further rotated through an angle of 135° (FIG. 5) the carrier 9 (designated A and B), having been turned clockwise, takes the position at 45° to the vertical, while the connecting rods 10 designated AC and BD begin moving the arms 4 designated OC and OD together to form an angle $\Delta_4<\Delta_3$. However, because the angles $\phi_1$ and $\phi_2$ are constant, the pistons 5 and 6 move apart to a position similar to that illustrated in FIG. 3.

When the output shaft has further rotated through an angle of 180° (FIG. 6) the connecting rods 10 designated AC and BD keep on moving the arms 4 designated OC and OD together to form an angle $\Delta_5<\Delta_4$. As this takes place, the pistons 5 and 6 are found to be brought to the vertical axis again just as in FIG. 2. The carrier 9 designated AB is positioned horizontally, but now below the output shaft 7 and the offset portion 8. The position of the kinematic links of FIG. 6 turns out to be axially symmetric with that of FIG. 2.

Hence the pistons 5 and 6 are found to be brought to the vertical axis (FIGS. 2, 4, and 6) following each turning of the output shaft 7 with the offset portion 8 through 90° beginning from the initial 0° position. Also, with every movement through 45° from the initial position, the pistons are found to be moved apart following each turning of the output shaft 7 with the offset portion 8 through 90° (FIGS. 3 and 5). Consequently, in operation of the positive displacement rotary-piston machine, such planetary train ensures rotational oscillations of the pistons 5 and 6 with a constant phase position against the stationary central gear 12, intake port 18 and exhaust port 19.

FIGS. 7-11 illustrate a cross-sectional view through the annular working chamber of the casing 1 of the simplest rotary internal combustion engine at various actual positions of the pistons 5 and 6 after the output shaft 7 has turned one-half revolution. This engine has the planetary train, the operation of which was discussed hereinabove in detail (FIGS. 2 through 6), the positions of the pistons 5 and 6 in FIGS. 2-6 being analoguos with those in FIGS. 7-11. In the annular working chamber of the engine, there may occur four variable subchambers providing space enclosed by the faces of the pistons 5 and 6 and by the casing 1. These four instant working subchambers are designated by encircled numerals from "1" to "4".

In FIG. 7, the instant working subchambers are:

"1" communicating with the intake port 18 and the carburetor 20 (for use in an external carburetion only) and, being the largest, corresponding to the completion of the intake stroke and the beginning of the compression stroke as in a rotary internal combustion engine;

"2" open to the spark plug 21 (for use in an external carburetion) and/or to the fuel injector (for use in an internal preparation of a working mixture) and, being the smallest, corresponding to the completion of the compression stroke and the beginning of the combustion stroke as in a rotary internal combustion engine;

"3" communicating with the exhaust port 19 and, being of the maximal volume, corresponding to the completion of the combustion stroke and the beginning of the exhaust stroke as in a rotary internal combustion engine;

"4", as the subchamber of the minimal volume, corresponding to the completion of the exhaust stroke and the beginning of the compression stroke as in a rotary internal combustion engine.

In FIG. 8,

"1" denotes a closed subchamber of a diminishing volume corresponding to the running of the compression stroke as in a rotary internal combustion engine;

"2" denotes a closed subchamber of an increasing volume corresponding to the running of the combustion stroke as in a rotary internal combustion engine;

"3" denotes a subchamber communicating with the exhaust port 19 and, being of a diminishing volume, corresponding to the running of the exhaust stroke as in a rotary internal combustion engine;

"4" denotes a subchamber communicating with the intake port 18 and the carburetor 20 and, being of an increasing volume, corresponding to the running of the intake stroke as in a rotary internal combustion engine;

In FIG. 9,

"1" denotes a closed subchamber of the minimal volume corresponding to the completion of the compression stroke and the beginning of the combustion stroke as in a rotary internal combustion engine;

"2" denotes a subchamber communicating with the exhaust port 19 and of the largest volume corresponding to the completion of the combustion stroke and the beginning of the exhaust stroke as in a rotary internal combustion engine;

"3" denotes a subchamber of the smallest volume corresponding to the completion of the exhaust stroke and the beginning of the intake stroke as in a rotary internal combustion engine;

"4" denotes a subchamber communicating with the intake port 18 and the carburetor 20 and of the largest volume corresponding to the completion of the intake stroke and the beginning of the compression stroke as in a rotary internal combustion engine;

It should be noted that the pistons 5 and 6 are in similar positions in FIGS. 7 and 9, while the machine operation differs from that of the rotary internal combustion engine by one-stroke shift. Also, the pistons 5 and 6 are in similar positions in FIGS. 8 and 10 as well as in FIGS. 9 and 11, while the physical processes in the instant subchambers "1"-"4" are one-stroke shifted where the output shaft 7 rotates through 90°. As can be seen in FIGS. 7 and 11, the pistons 5 and 6 are also in similar positions, but the physical processes in the instant subchambers "1"-"4" are two-stroke shifted where the output shaft 7 rotates through 180°. Where the output shaft 7 rotates through 360° the physical processes in the instant subchambers will be four-stroke shifted as in a rotary internal combustion engine. Consequently, the running cycle of a rotary internal combustion engine involving all four instant subchambers will be repeated from one revolution of the output shaft 7 to the next.

In operation of the simplest rotary internal combustion engine, the gear rim 13 (FIG. 1) is functioning as an engine flywheel, therefore it must be heavy to overcome the negative component of the torque as well as to "smooth" the actual torque produced on the output shaft 7.

A cooling liquid is forced through spaces defined by walls 22 to prevent overheating of the rotary internal combustion engine. There is a system for cooling the pistons 5 and 6 with oil (not shown).

FIG. 12 illustrates the simplest rotary internal combustion engine comprising the casing 1 with the precombustion chamber 23 wherein there is the fuel injector 21 for internally preparing the working medium. The planetary train will be adjusted to provide for the phase of closing the pistons 5 and 6 as the compression stroke is nearing completion in alignment with the transfer passage 24. In operation of the engine when a gas is flowing from the working chamber to the precombustion chamber 23 there is formed a vortex flow in the precombustion chamber 23 due to a tangential extension of the transfer passage 24 thus promoting an improved and quick mixing of air and the fuel as well as a high rate of combustion.

FIG. 13 illustrates the simplest rotary internal combustion engine comprising the casing 1 with a toroidal working chamber. This engine operates in the same way as that described above with references to FIGS. 1 and 7-11 and having the annular working chamber. But the toroidal working chamber makes it possible to do away with angular joints between sealing components and to use compression rings to thereby minimize leaks of compressed gases and simplify the sealing system of the pistons 5 and 6.

In FIG. 14, the rotary internal combustion engine comprises the output shaft 7 having two offset portions 8. The casing 1 consists of two stages arranged between two planetary trains, such as described above with reference to FIGS. 2-6. The stages of the casing 1 as well the offset portions 8 on the common output shaft 7 can be set at an angle relative to each other so that the torques produced at both stages should be combined on the output shaft 7. The amount of the setting may amount to 180° and depends on the various applications of the engine. The angles of setting are usually chosen such as to ensure phase shifting of the maximal and minimal amplitudes of the torques produced at each stage to produce the most "smoothed" total torque.

FIG. 15 represents a graph approximated with a sinusoid showing variations in torque M=f(ϕ), where ϕ is an angle of rotation of the output shaft 7 of the simplest rotary internal combustion engine (FIGS. 1, 7-11, 13) having a single-stage casing 1. In this case, the torque has not only a high torque-variation amplitude, but a negative component as well. In order to overcome the negative component, the gear rim 12 must be heavy to serve as a balance wheel, but the engine gets heavier.

The rotary internal combustion engine with the two-stage casing 1 (FIG. 14) produces a smooth resultant torque because the torques of both stages are combined on the common output shaft 7. In FIG. 16, curve "A" is a graph approximated with a sinusoid showing variations in the torque of the left-hand stage, curve "B" is that of the right-hand stage, and curve "C" is a graph showing the total torque. Consequently, the rotary internal combustion engine with the two-stage casing 1 provides for a novel quality, i.e. the output torque is possible without a negative component and without high jumps in the torque magnitude. In operation, such engine under load will be exposed to a lower level of vibrations. This will have a beneficial effect on the reliability and service life of both the engine and the load. In this case the gear rim 13 can be as light-weight as possible on conditions that they sufficiently strong to thus reduce the weight of the rotary internal combustion engine.

FIGS. 17-29 illustrate the operation of the planetary train similar to that described with references to FIGS. 2-7 but with the gear ratio i=⅔ of a gear pair including the gears 11 and 12 in cooperation with the drive shafts 2 and 3 each carrying three pistons 5 and 6.

In FIG. 17, an initial angular position of the pistons 5 and 6 and of their drive mechanism where the arbitrary initial angular position of the output shaft 7 is 0° and the offset portion 8 (line OQ) is in the vertical position. In this initial position, the carrier is positioned horizontally above the axis of the output shaft 7 and above the offset portion 8.

Next, the output shaft 7 together with the offset portion 8 rotates anticlockwise. At the same time, by virtue of mechanical linkages, the planetary gear 11 rolls over the stationary central gear 12. The planetary gear 11 imparts motion to the carrier 9, which is rigidly connected to the planetary gear 11. The carrier 9 transmits motion to the arms 4 of the drive shafts 2 and 3 via the connecting rods 10. The drive shafts 2 and 3 set in motion the pistons 5 and 6.

Referring to FIG. 18, the output shaft 7 and the offset portion 8 (line OQ) are shown as turned through 30° counterclockwise. The planetary gear 11 and the carrier 9 are also shown as turned through 30°, but clockwise. Further, FIGS. 19-29 show consecutive positions of the members of the planetary train and corresponding positions of the pistons 5 and 6 each time after angular displacements through 30°.

It can be readily seen that, beginning from the initial 0° position, rotation of the output shaft 7 through each 120° (240°, 360°, etc.) causes the side faces of the pistons 5 and 6 to be moved together at the same place relative to the position of the teeth of the stationary central gear 12 and the casing 1. This provides consistency in the stage of bringing the side faces of the pistons 5 and 6 together relative to the intake port 18 and the exhaust port 19. This enables implementation of the Stirling principle in the rotary-piston machine.

FIGS. 30-34 illustrate a diagrammatic section through the working chamber of the casing 1 of the simplest external combustion engine implementing the Stirling principle. The engine has a planetary train with the gear ratio i=⅔ of the gears 11 and 12 as described with reference to FIGS. 17-29. In this engine, the working chamber of the casing 1 is provided with 3 pairs of the intake ports 18 and the exhaust ports 19 arranged at an angle of 120° relative to each other. Enclosed by the side faces of the pistons 5 and 6 and the walls the working chamber, there are 6 working subchambers designated by encircled numerals from "1" to "6". Each pair of the intake port 18 and the exhaust port 19 terminates in a specific device:

- the upper pair of ports 18 and 19 terminates in the generator 26 and the cooler 27 of exhaust gases;
- the left-hand pair of ports 18 and 19 terminates in the additional cooler 28.

In the initial position (FIG. 30), the faces of the pistons 5 and 6 are brought together. This enables the maximum compression of the working gas in the space of:

- the heater 25 to effectively supply heat from an external source at the maximum density of the working gas;
- the generator 26 and the cooler 27 of exhaust gases to effectively pump the working gas therethrough;
- the additional cooler 28 to effectively take away heat from the working gas at its maximum density and compression heating.

Further rotation of the output shaft 7 (FIG. 31) causes the faces of the pistons 5 and 6 to close on the one side and to move apart on the other. At the same time,

- in the instant subchamber "1", there occurs the expansion stroke as the working gas expands due to heating in the heater 25;
- high-temperature exhaust gases pass from the subchamber "2" to the subchamber "3" via the regenerator 26 and the cooler 27 of exhaust gases. In the process, the exhaust gases first carry off their initial high temperature to the working gas entering the heater 25 and then are cooled in the cooler 27 of exhaust gases.
- precooled exhaust gases flow from the subchamber "4" to the subchamber "5" via the additional cooler 28 where their temperature further decreased;
- the working gas cooled in the cooler 27 of exhaust gases and the additional cooler 28 is compressed in the subchamber "6" with the minimal mechanical energy consumption for the compression of the gas.

Further rotation of the output shaft 7 (FIG. 32) causes the faces of the pistons 5 and 6 continue to move apart on the one side and to come together on the other. At the same time,

- the processes illustrated in FIG. 31 take place in the subchambers "1," "2," "3," "4," and "5;"
- the working gas starts to flow from the subchamber "6" to the subchamber "1" to be then heated first in the regenerator 26, then in the heater 25.

Further rotation of the output shaft 7 (FIGS. 33 and 34) causes the faces of the pistons 5 and 6 continue to move apart on the one side and to come together on the other. At the same time,

- the processes illustrated in FIG. 32 take place in the subchambers "1," "2," and "3."
- the subchamber "4" diminishes until cut off the subchamber "5." As a result, pressure in the space common to both the subchamber "4" and the additional cooler 28 increases, while the temperature rise is limited to heat removal from the working gas in the additional cooler 28. In this way, mechanical energy losses are minimized in the engine when the working gas is subsequently compressed prior to its heating.
- the subchamber "5" also appears to be cut off the subchamber "4." It is readily noted that the location of the subchamber "5" in FIG. 34 is in complete correspondence with the location of the subchamber "6" in FIG. 30, as are physical processes taking place therein.

the location of the subchamber "6" of FIG. 34 is in correspondence with the location of the subchamber "1" in FIG. 30, as are physical processes taking place therein.

Consequently, the working processes of the instant engine with an external heat supply as in the Stirling engine are cycled to produce work.

FIGS. 35-41 illustrate the operation of the planetary train similar to that described with references to FIGS. 2-7 and 17-29 but with the gear ratio i=¾ of a gear pair including the gears 11 and 12 in cooperation with the drive shafts 2 and 3 each carrying three pistons 5 and 6.

In FIG. 35 (as in FIG. 2 and FIG. 17), an initial angular position of the pistons 5 and 6 and of their drive mechanism where the arbitrary initial angular position of the output shaft 7 is 0° and the offset portion 8 (line OQ) is in the vertical position. In this initial position, the carrier 9 is positioned horizontally above the axis of the output shaft 7 and above the offset portion 8.

Next, the output shaft 7 together with the offset portion 8 rotates anticlockwise. At the same time, the planetary gear 11 rolls over the stationary central gear 12. The planetary gear 11 imparts motion to the carrier 9, which is rigidly connected to the planetary gear 11. The carrier 9 transmits motion to the arms 4 of the drive shafts 2 and 3 via the connecting rods 10. The drive shafts 2 and 3 set in motion the pistons 5 and 6.

Referring to FIG. 36, the output shaft 7 and the offset portion 8 (line OQ) are shown as turned through 45° counterclockwise. The planetary gear 11 and the carrier 9 are also shown as turned through 45°, but clockwise. Further, FIGS. 37-41 show consecutive positions of the members of the planetary train and corresponding positions of the pistons 5 and 6 each time after angular displacements through 45°.

It can be readily seen that, beginning from the initial 0° position, rotation of the output shaft 7 through each 135° (270°, 405°, 540°, etc.) causes the side faces of the pistons 5 and 6 to be moved together at the same place relative to the position of the teeth of the stationary central gear 12. This provides consistency in the stage of bringing the side faces of the pistons 5 and 6 together relative to the intake port 18 and the exhaust port 19. This enables like strokes to be made concurrently in one working chamber of the casing 1 of the rotary internal combustion engine. In this case, the like strokes will be symmetrical about the axis of the output shaft 7.

FIG. 42 illustrates a section through the working chamber of the casing 1 of a rotary internal combustion engine. The engine has a planetary train with the gear ratio i=¾ of the gears 11 and 12, described with reference to FIGS. 35-41, and intake ports 18, exhaust ports 19, carburetors 20, and spark plugs 21 (in case of external carburetion), all arranged symmetrically about the axis of the casing 1. In this engine, the working chamber of the casing 1 is provided with 4 pistons 5 and 6 on each drive shaft 2 and 3, the pistons forming 8 working subchambers enclosed by the faces of the pistons 5 and 6 and by the wall of the working chamber of the casing 1. Similarly to the designations for the engine with 4 subchambers (FIG. 10), FIG. 42 illustrates the working subchambers seen in the upper portion of the working chamber as designated by encircled numerals from "$\mathbf{1}^1$" to "$\mathbf{4}^1$". The other 4 working subchambers designated by encircled numerals from "$\mathbf{1}^2$" to "$\mathbf{4}^2$" are in the lower portion of the working chamber. When the pistons 5 and 6 move clockwise, the following concurrent processes take place in the instant subchambers:

an expansion stroke in "$\mathbf{1}^1$" and "$\mathbf{1}^2$", ejection of exhaust gases in "$\mathbf{2}^1$" and "$\mathbf{2}^2$", an intake stroke in "$\mathbf{3}^1$" and "$\mathbf{3}^2$"

a compression stroke in "$\mathbf{4}^1$" and "$\mathbf{4}^2$".

The rotary internal combustion engine operating with concurrent strokes in one working chamber compared with the simplest rotary internal combustion engine features the following properties that provide for reliable operation and enhanced service life:

balanced heating of the casing 1 to minimize its thermal strain, both under transient-state conditions and during constant-load operation;

symmetry of the torque delivered to the pistons 5 and 6, which relieves to a large degree the bearings of the drive shafts 2 and 3 of their load.

Generally, concurrent like strokes in the rotary-piston machine of the invention equipped with the planetary trains described hereinabove depend from both the number of strokes in an operating cycle and the number of instant subchambers in the working chamber (stage) of the casing 1 cut off by the faces of the rotary pistons 5 and 6.

For example, the operating cycle of a rotary internal combustion engine consists of 4 strokes: "intake," "compression," "expansion," and "ejection of exhaust gases." To accomplish such cycle, the rotary-piston machine with the planetary trains described hereinabove must have at least 4 instant subchambers (see FIGS. 7-11). But the rotary internal combustion engine operating with concurrent strokes in one working chamber must have at least 8 instant subchambers (see FIG. 42). If the rotary-piston machine is used for blowing gases, the operating cycle has only 2 strokes: "intake" and "exhaust." In this case concurrent like strokes can only be made in 4 instant subchambers, exactly as in the simplest rotary internal combustion engine (FIGS. 7-11).

Hence the number of concurrent like strokes in the rotary-piston machine equipped with the planetary trains described hereinabove is:

$$k=m/t,$$

where k is the number of concurrent like strokes;

m is the number of instant subchambers in the working chamber (stage) of the casing 1; and t is the number of strokes in an operating cycle.

Referring now to FIG. 43, there is shown a positive displacement rotary-piston machine with the planetary train described hereinabove (see FIGS. 2-6) for use as a blower (compressor). The machine is driven off the output shaft 7, which is set in motion by an external source of power. The machine has straightway valves 29, such leaf shutters, disposed between a bifurcated exhaust port 19 and the working chamber of the casing 1 and providing for a unidirectional flow of the working substance, e.g. gas, from the subchamber where its volume is diminishing as a result of bringing together the faces of the rotary pistons 5 and 6 through the exhaust port 19 to the subchamber, in which pressure is lower.

In such rotary-piston machine, like intake and exhaust strokes take place concurrently.

INDUSTRIAL APPLICABILITY

The positive displacement rotary-piston machine according to the invention and various forms of its structure are simple to produce in modern engineering plants. They can be manufactured from any suitable engineering materials, so they are suitable for serial production.

Literature: Stirling Engines. Grehem T. Reader, Charles Hooper. London New York; E&F. N. Spon).

The invention claimed is:

1. A positive displacement rotary-piston machine comprising:

(a) a casing having an annular working chamber and an intake port and exhaust port, (b) first and second drive shafts coaxial with the annular surface defining the annular working chamber and provided with pistons on one end thereof and with arms on the other end thereof, (c) a stationary central gear coaxial with the surface defining the working chamber and with the first and second drive shafts, (d) an output shaft concentric with the first and second drive shafts and having a carrier, (e) crankshafts connected to the arms of the carrier of the output shaft and carrying planetary gears meshed with the stationary central gear, (f) connecting rods linking the arms of the first and second drive shafts and the crankshafts, characterized in that the output shaft has an offset portion carrying the carrier and a planetary gear, the planetary gear being in mesh with the stationary central gear on the internal teeth thereof with a gear ratio $i=n/(n+1)$, where n is an integer (i.e. n=1, 2, 3 . . . , a series of integers), the carrier is pivotally connected to the arms of the first and second drive shafts through the connecting rods, and the number of vanes mounted on each of the first and second drive shafts is n+1.

2. The positive displacement rotary-piston machine of claim 1, characterized in that the annular working chamber of the casing is toroidal.

3. The positive displacement rotary-piston machine of claim 1, characterized in that the casing has a precombustion chamber communicating with the annular working chamber through a transfer passage.

4. The positive displacement rotary-piston machine of claim 3, characterized in that the transfer passage is tangential with respect to the precombustion chamber.

5. The positive displacement rotary-piston machine of claim 1, characterized in that first and second stages each have an annular working chamber and the first and second drive shafts and the vanes that are accommodated in their respective annular working chamber, and the output shaft has the offset portion in both the first and second stages carrying their respective carrier and their respective planetary gear, each of the respective planetary gears being in mesh with their respective stationary central gear and their respective carriers being pivotally connected to their respective arms of the respective first and second drive shafts through their respective connecting rods, and the offset portion of the first and second stages is set at an angle of 0° through 180° relative to each other.

6. The positive displacement rotary-piston machine of claim 1, characterized in that the intake port and exhaust port are respectively connected in pairs to:

a heater, regenerator coupled with a cooler of exhaust gases and to an additional cooler.

7. The positive displacement rotary-piston machine of claim 1, characterized in that straightway valves are set at the junction of the exhaust port and the annular working chamber.

* * * * *